US007626547B2

(12) United States Patent
Schillmeier et al.

(10) Patent No.: US 7,626,547 B2
(45) Date of Patent: Dec. 1, 2009

(54) EMBEDDED PLANAR ANTENNA WITH PERTAINING TUNING METHOD

(75) Inventors: Gerald Schillmeier, München (DE); Frank Mierke, München (DE)

(73) Assignee: Kathrein-Werke KG, Rosenheim (DE)

( * ) Notice: Subject to any disclaimer, the term of this patent is extended or adjusted under 35 U.S.C. 154(b) by 525 days.

(21) Appl. No.: 11/547,495

(22) PCT Filed: Mar. 24, 2005

(86) PCT No.: PCT/EP2005/003184

§ 371 (c)(1),
(2), (4) Date: Nov. 1, 2006

(87) PCT Pub. No.: WO2005/096433

PCT Pub. Date: Oct. 13, 2005

(65) Prior Publication Data

US 2008/0278375 A1 Nov. 13, 2008

(30) Foreign Application Priority Data

Apr. 1, 2004 (DE) ..... 10 2004 016 158

(51) Int. Cl.
*H01Q 1/38* (2006.01)

(52) U.S. Cl. ..... 343/700 MS; 343/829; 343/846

(58) Field of Classification Search ..... None
See application file for complete search history.

(56) References Cited

U.S. PATENT DOCUMENTS 6,064,351 A * 5/2000 Mandai et al. ..... 343/873
6,697,019 B1 2/2004 Hyuk-Joon et al.
6,995,709 B2 * 2/2006 Spittler ..... 343/700 MS
2002/0057220 A1 5/2002 Sabet et al.
2008/0042915 A1 * 2/2008 Schillmeier et al. ..... 343/745
2008/0122697 A1 * 5/2008 Mierke et al. ..... 343/700 MS

FOREIGN PATENT DOCUMENTS

| | | | |
|---|---|---|---|
| EP | 0637094 | A1 | 2/1995 |
| EP | 0863570 | A2 | 9/1998 |
| EP | 1094545 | A2 | 4/2001 |
| EP | 1251588 | A2 | 10/2002 |
| WO | WO00/22695 | | 4/2000 |
| WO | WO03/079488 | A2 | 9/2003 |

OTHER PUBLICATIONS

James, JR and Hall, PS, "Handbook of Microstrip Antennas, vol. 1,"Peter Peregrinus Ltd., London UK, pp. 592-597 (1989).

(Continued)

*Primary Examiner*—Trinh V Dinh
(74) *Attorney, Agent, or Firm*—Nixon & Vanderhye PC

(57) ABSTRACT

A patch antenna comprising an electrically conductive ground plane; a first dielectric substrate layer arranged on said ground plane and having a first relative permittivity; at least one electrically conductive effective area arranged on the first dielectric substrate layer and electrically connected to one end of an electrically conductive feed line; at least one second dielectric substrate layer arranged on the effective area and having a second relative permittivity; whereby the second relative permittivity is larger or equal the first relative permittivity.

18 Claims, 5 Drawing Sheets

OTHER PUBLICATIONS

Guha, Debatosh and Siddiqui, Jawad Y., "Resonant Frequency of Circular Microstrip Antenna Covered With Dielectric Superstrate," *IEEE Transactions on Antennas and Progagation*, vol. 51, No. 7, pp. 1649-1652 (Jul. 2003).

Huang Chih-Yu et al., "Gain-enhanced compact broadband microstrip antenna," *Electronics Letters*, vol. 34, No. 2, pp. 138-139 (Jan. 22, 1998).

Bahl, I.J. and Bhartia, P., "Microstrip Antennas," Artech House, Inc., pp. 76-81 (1980).

* cited by examiner

EMBEDDED PLANAR ANTENNA WITH PERTAINING TUNING METHOD

This application is the US national phase of international application PCT/EP2005/003184, filed 24 Mar. 2004, which designated the U.S. and claimed priority of DE 10 2004 016 158.5, filed 1 Apr. 2004, the entire contents of each of which are hereby incorporated by reference.

The invention relates to a planar antenna, in particular a patch antenna, and a method for producing an antenna of this type.

Patch antennas are known from the prior art. Antennas of this type comprise at least one electrically conductive effective area, arranged opposite a ground plane. A dielectric substrate is provided between the ground plane and effective area. The effective area is connected to a feed line and radiates an electromagnetic field when an alternating voltage is applied to the feed line.

It is known from the prior art to apply, in addition to the dielectric substrate layer provided between the ground plane and effective area, a further substrate layer to protect the effective area on its upper side. The radiation characteristic of the patch antenna is not to be changed by this, so materials with small relative permittivities are used for the further substrate layer.

In the patch antennas known from the prior art it has proven to be disadvantageous that the antennas can often not be precisely tuned to specific radiation profiles.

The document WO 03/079 488 A2 shows a patch antenna with a lower effective area and an upper effective area, the upper effective area having a smaller size than the lower effective area. Located between the lower effective area and the ground plane of the antenna is a first dielectric substrate layer with a low permittivity and located between the lower and the upper effective area is a second dielectric substrate layer with a high permittivity.

It is therefore an object of the invention to provide a planar antenna, in particular a patch antenna, which can easily be tuned to desired radiation characteristics. It is also an object of the invention to provide a corresponding production method for an antenna of this type.

This object is achieved by the independent claims. Developments of the invention are defined in the dependent claims.

A second dielectric substrate layer with a second relative permittivity is located as the uppermost layer of the antenna on the electrically conductive effective area of the antenna according to the invention, the second relative permittivity being larger or equal to the first relative permittivity of the first dielectric substrate layer provided between the ground plane and effective area. The invention is thus based on the recognition that the use of a second substrate layer with a high relative permittivity can influence the radiation characteristic of the antenna in an advantageous manner. As a result, the antenna can easily be tuned to desired radiation characteristics. In particular, it was recognized that the second dielectric substrate layer cannot only take on the function of a protective layer, but can also be used to tune the antenna.

In a preferred embodiment of the antenna, the first relative permittivity is selected to be between 1 and 8. The second relative permittivity is preferably selected to be between 4 and 20.

In a further variant of the antenna according to the invention, the thickness of the first dielectric substrate layer is larger than or equal to the thickness of the second dielectric substrate layer.

In a preferred configuration of the antenna according to the invention, the thickness of the second dielectric substrate layer is larger than 10% of the thickness of the first dielectric substrate layer, in particular larger than 20%, preferably larger than 30%, particularly preferably larger than 40% or larger than 60% or larger than 80%. Furthermore, the thickness of the second substrate layer is preferably smaller than 200% of the thickness of the first substrate layer, in particular smaller than 100% or smaller than 80% or smaller than 60%.

The first and/or second dielectric substrate layer and/or the effective area and/or the ground plane, in plan view of the antenna, are preferably circular or polygonal in design. Furthermore, the first and the second dielectric substrate layer, in plan view of the antenna, may have different sizes, and the edge of the first dielectric substrate layer can extend obliquely to the axial axis in axial section. Owing to the measures just mentioned, the radiation characteristic is also influenced.

In a further variant of the invention, the feed line is arranged in an opening extending through the ground plane and the first dielectric substrate layer and connected at one end of the opening to the effective area. By varying the position of the contact point on the effective area, the electric properties and the radiation characteristic of the antenna are also changed.

In a particularly preferred embodiment of the invention, the first and/or second dielectric substrate layer and/or the effective area comprise one or more recesses, which, in plan view, uncover a partial region of the effective area or extend at least partially through the effective area. By providing such recesses, a further possibility is created, with which patch antenna can be easily tuned. Depending on the desired radiation characteristic, material can be removed from the various layers of the antenna, the removal of material being continued until the desired tuning is achieved.

In an advantageous configuration, at least one of the recesses on one side is open, the open side resting on an edge of the antenna, in plan view. The length of the open side here is at least 1/20 and at most half of the total length of the edge. In a variant, the open side of at least one recess is substantially arranged in a central region of the edge of the antenna, the recess extending, in plan view, from the open side into the interior of the antenna. Alternatively, at least one recess can be arranged in a corner region of the antenna, in plan view.

In a further embodiment of the antenna according to the invention, at least one recess extends in the direction of the axial axis through the second substrate layer to the effective area, the recess being arranged, in plan view, over the end of the electric feed line. The radiation characteristic can be changed particularly effectively by this type of positioning of the recess. The above-described recesses, in plan view, preferably have an n-polygonal or a circular form.

In a particularly preferred variant of the invention, the antenna comprises a multi-layer structure, i.e. a plurality of first and second dielectric substrate layers located one above the other, and effective areas lying in between, are provided.

The antenna according to the invention is preferably produced by a production method which has the following steps:

a) a first dielectric substrate layer, with a first relative permittivity is arranged on an electrically conductive ground plane;

b) an electrically conductive effective area is arranged on the first dielectric substrate layer and electrically connected to one end of an electrically conductive feed line;

c) a second dielectric substrate layer with a second relative permittivity is arranged, as the uppermost layer of the antenna, on the effective area, the second permittivity being larger or equal to the first relative permittivity.

In a particularly preferred variant of the production method, after carrying out steps a) to c), one or more recesses are provided in the first and/or second dielectric substrate layer and/or in the effective area. In this manner, the radiation properties of the antenna can easily be changed at the end of the production process.

Embodiments of the invention will be described below with the aid of the accompanying figures, in which.

Figure 1:
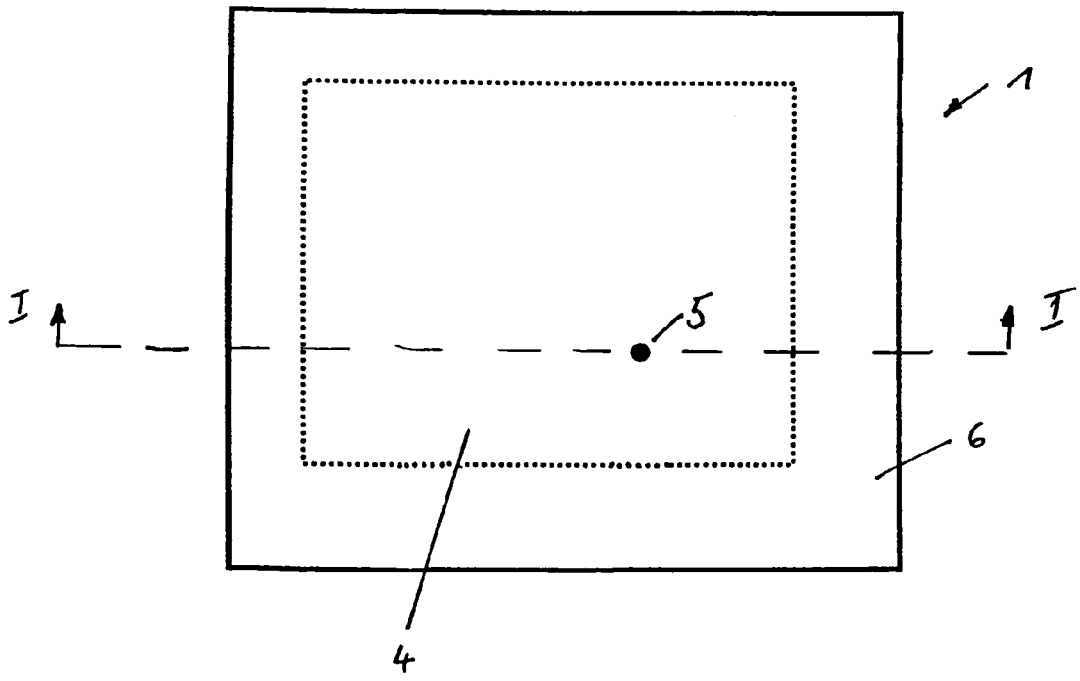
FIG. 1 shows a plan view of an embodiment of the antenna according to the invention.

The antennas described below are so-called patch antennas, in which an electromagnetic radiation takes place via an effective area in the form of a patch area. FIG. 1 shows a plan view of a configuration of a patch antenna of this type. A rectangular patch area 4, the edge of which is indicated by dotted lines, is connected on the lower side to a feed line 5 extending perpendicularly to the patch area. It is also conceivable for the feed line to not extend perpendicularly to the patch area, but obliquely thereto. The upper side of the patch area is covered by a rectangular substrate area 6, which projects over the patch area 4.

Figure 2:
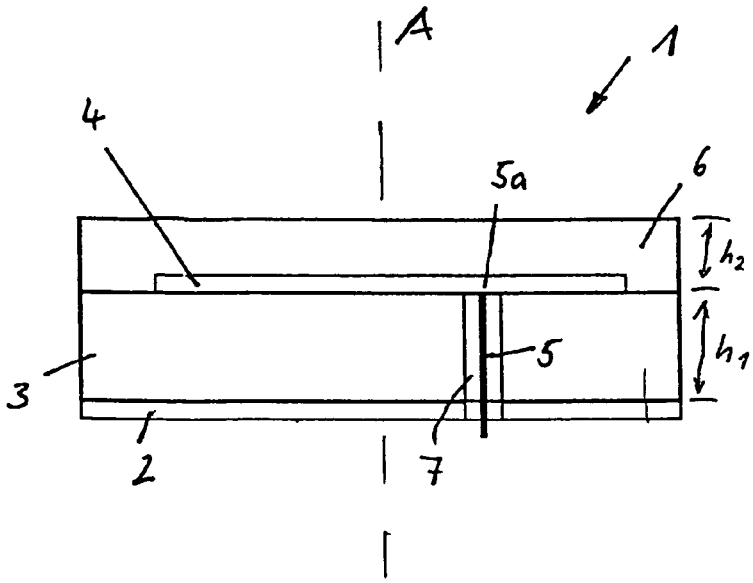
FIG. 2 shows a sectional view along the line I-I of the antenna of FIG. 1.

FIG. 2 shows a sectional view along the line I-I of the patch antenna of FIG. 1. It can be seen that the antenna has a large number of layers arranged one above the other along an axial axis A. The lowermost layer is an electrically conductive ground plane 2, on which a first dielectric substrate layer 3 is located. The electrically conductive patch area 4 is applied to this layer 3 and is connected to the end 5*a* of the electrically conductive feed line 5. The feed line is arranged in an opening 7 extending through the ground plane 2 and the first substrate layer 3 and contacts the lower side of the patch area 4. Highly conductive material, such as, for example, copper is used as the material for the patch area 4. Located above the patch area is the dielectric substrate layer 6, which is designated below as the second dielectric substrate layer. The thickness h1 of the first dielectric substrate layer 3 is preferably 2 to 10 millimeters and the thickness h2 of the second dielectric substrate layer 6 is preferably 0.5 to 5 millimeters. The thickness h2 is preferably larger than 10% of the thickness h1, in particular larger than 20%, preferably larger than 30%, particularly preferably larger than 40% or larger than 60% or larger than 80%. Furthermore, the thickness h2 is preferably smaller than 200% of the thickness h1, in particular smaller than 100% or smaller than 80% or smaller than 60%. Electric voltage is applied to the feed line 5, the patch area 4 acting as a resonator and radiating an electromagnetic field.

In the prior art, the second dielectric substrate layer 6 is merely provided for protection and is not to influence the electric properties of the patch antenna. A material with a very small relative permittivity is therefore selected as the material for the second substrate layer. In contrast to this, according to the invention, a material with a high permittivity is selected for the second dielectric substrate layer, said permittivity being at least as large as the permittivity of the first dielectric substrate layer 3. A selection of this type of the permittivity is based on the recognition that the radiation characteristic of the patch antenna can be positively influenced by this, with good fine tuning of the radiation characteristic being possible during manufacture of the particular antenna by corresponding choice of the permittivity.

Figure 3:
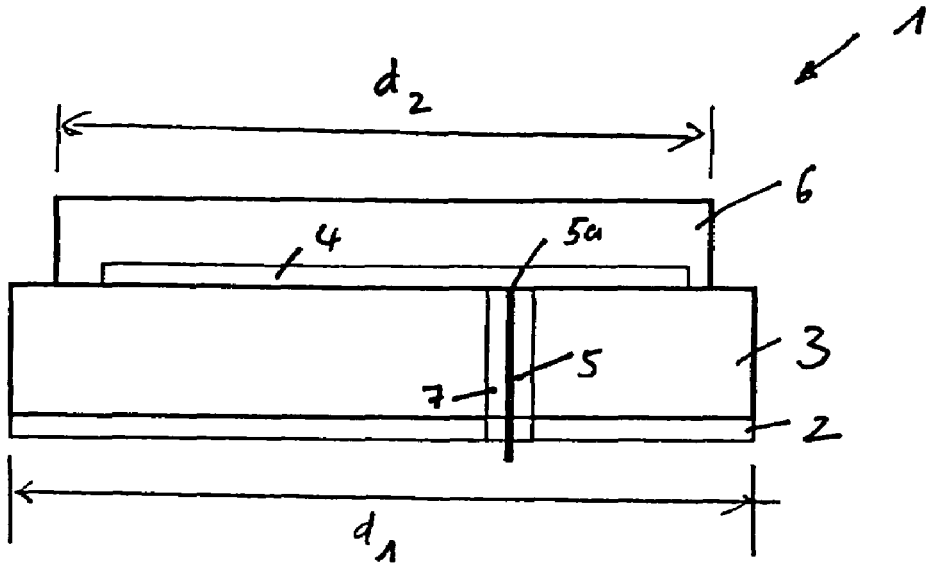
FIG. 3 shows a sectional view similar to FIG. 2 of a further embodiment of the antenna according to the invention.

FIG. 3 shows a sectional view of a further embodiment of a patch antenna according to the invention. The patch antenna of FIG. 3 corresponds substantially to the patch antenna of FIG. 2 with the difference that the width d2 of the second dielectric substrate layer is smaller than the width d1 of the first dielectric substrate layer. The radiation characteristic of the patch antenna can also be influenced in this manner.

Figure 4:
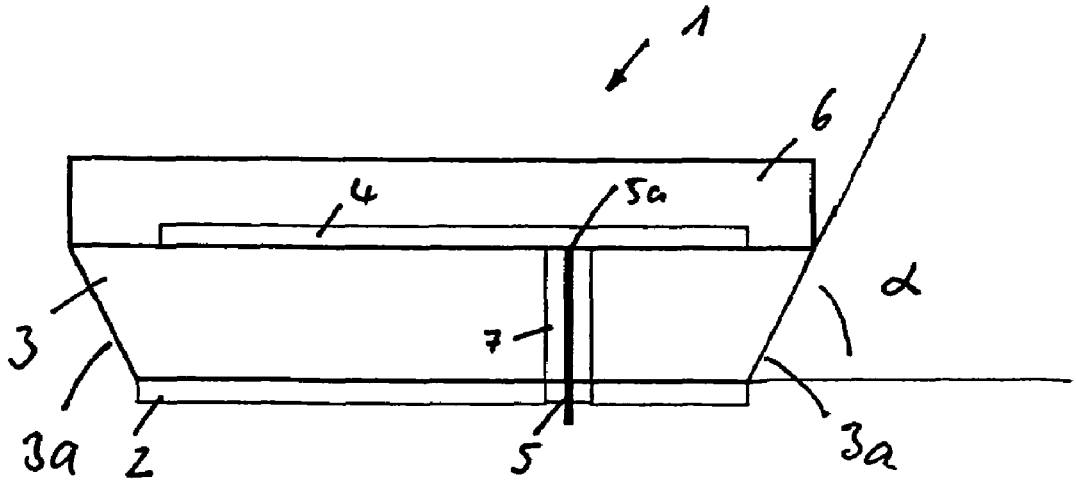
FIG. 4 shows a sectional view similar to FIG. 2 of a further modification of the antenna according to the invention.

FIG. 4 shows a further configuration of the patch antenna according to the invention in a sectional view, a further fine tuning of the radiation characteristic being carried out in that the upper and lower side of the first dielectric substrate layer 3 are not the same size, so an oblique edge 3*a* runs at an angle $\alpha$ to the lower side between the lower side and upper side.

Figure 5:
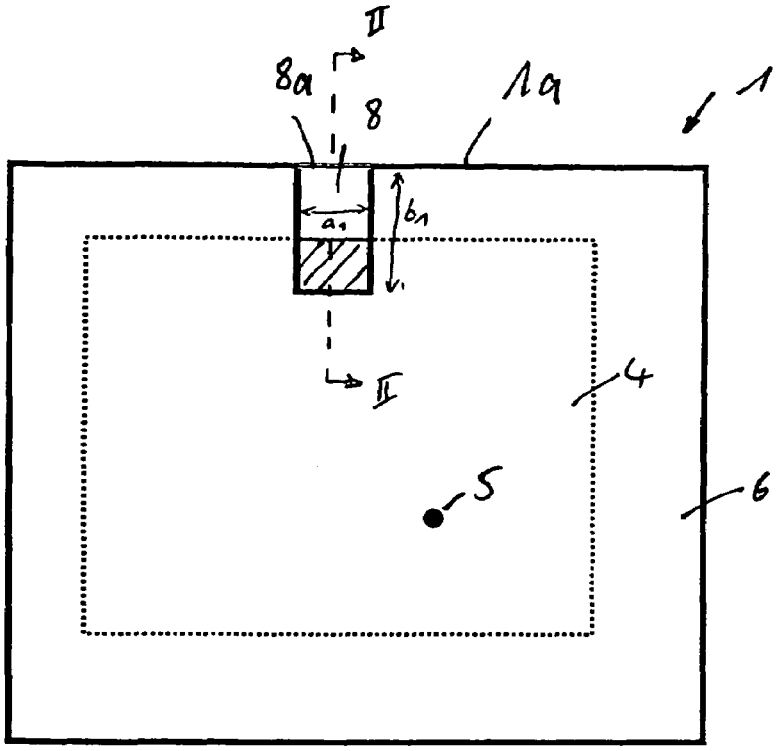
FIG. 5 shows a plan view of an embodiment of the antenna according to the invention with a recess at the edge of the antenna.

FIG. 5 shows a plan view of an embodiment of the patch antenna according to the invention, in which further influencing of the radiation properties of the antenna is brought about by a recess 8, the recess extending from the upper side of the second dielectric substrate layer to the upper side of the patch area 4. The recess 8 has an open side 8*a*, which coincides with a part of the upper edge 1*a* of the patch antenna. The width a1 of the recess is preferably at least 1/20 of the total length of the upper edge 1*a* and preferably at most half the total length of the upper edge 1*a*. The length b1 of the recess is selected such that at least a part of the patch area 4 is uncovered. In FIG. 5, the region of the upper side of the patch area, which is uncovered by the recess 8, is indicated by hatching.

Figure 5A:
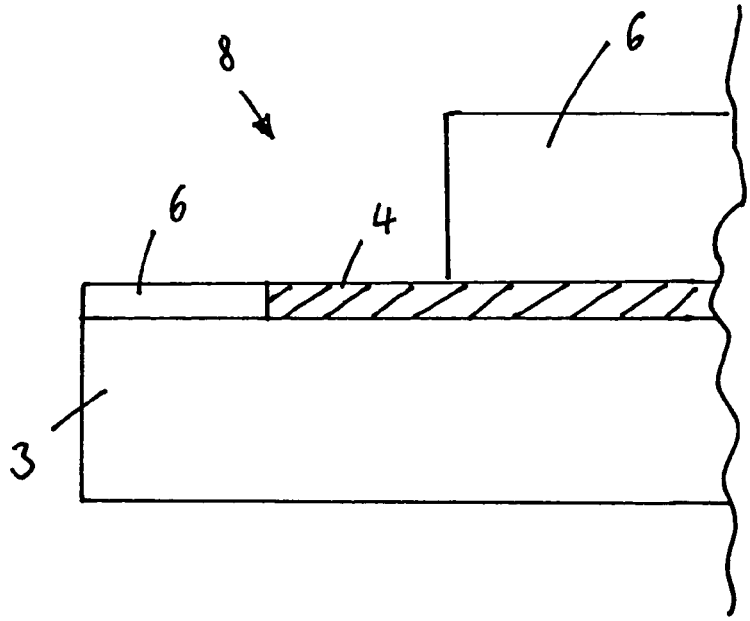
FIG. 5A shows a sectional view of the recess shown in FIG. 5 along the line II-II in FIG. 5.
Figure 5B:
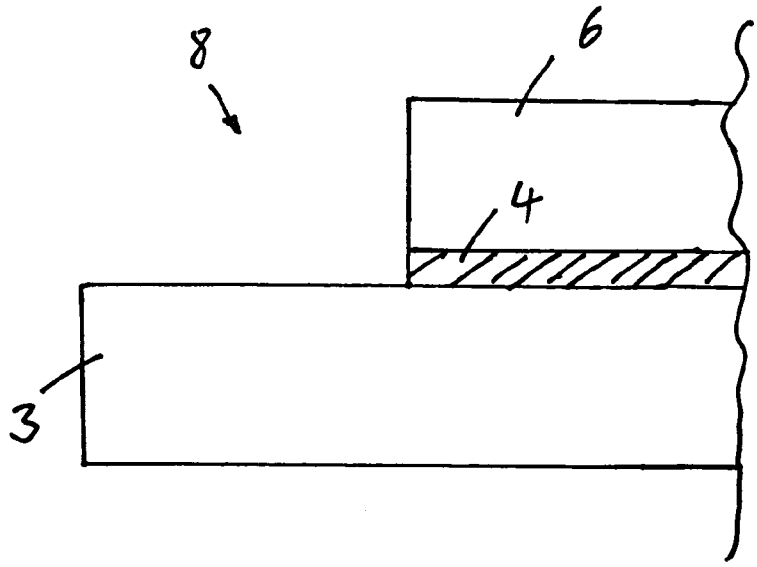
FIG. 5B shows a sectional view similar to FIG. 5A, which shows an alternative embodiment of the recess in the antenna.

FIG. 5A shows a sectional view of the recess shown in FIG. 5 along the line II-II. It can be seen, in particular, that for the recess, only material of the second layer 6 has been removed, specifically up to the upper side of the patch area 4. The base of the recess is therefore formed by material of the layer 6 on the left-hand edge and by the patch area 4 on the right-hand edge. It is also conceivable that material of the patch area 4 and further material of the layer 6 be removed for the recess. As shown in FIG. 5B, the total material of the layer 6 and the patch area 4 can be removed, for example, so the base of the recess consists of material of the layer 3. Likewise, the recess may extend only or additionally into the layer 3, so the lower side of the patch area 4 is uncovered, for example.

Figure 6:
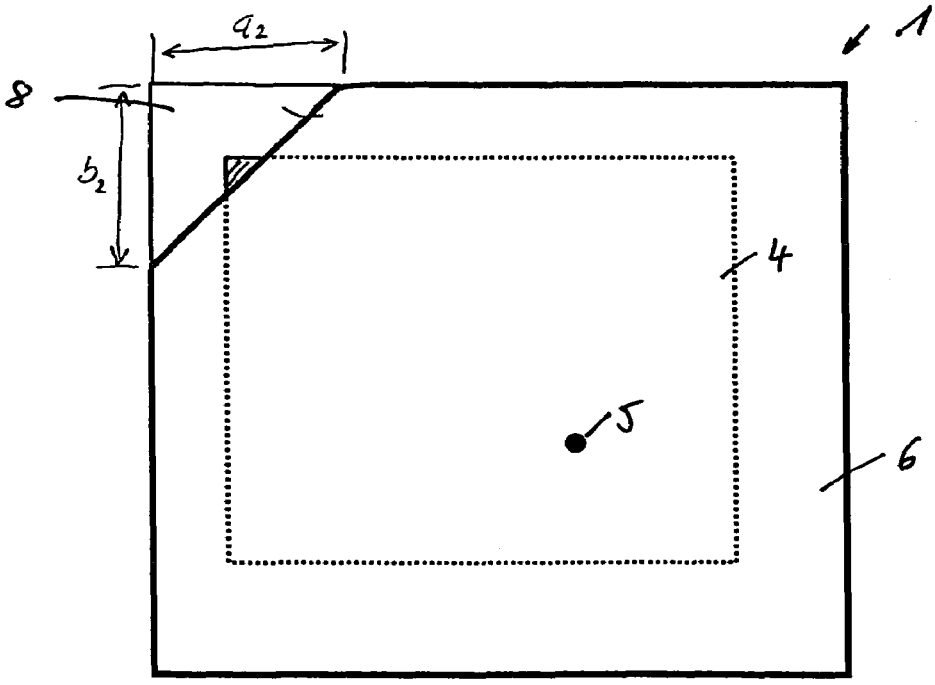
FIG. 6 shows a plan view of an embodiment of the antenna according to the invention with a recess in the corner region of the antenna.

FIG. 6 shows a plan view of a further embodiment of a patch antenna according to the invention, the radiation characteristic being influenced by a recess 8 in the left-hand upper corner of the patch antenna. The recess is substantially triangular and two sides of the recess coincide with edges of the antenna. The lengths a2 or b2 of the triangular sides are selected in this case such that the recess uncovers at least a part of the patch area 4, the uncovered part being indicated in turn by hatching.

Although in the embodiments of FIGS. 5 and 6, the recesses are provided in the second dielectric layer 6, it is also conceivable for the recesses to also extend into the patch area and the first dielectric layer 3. Furthermore, the recesses may be provided exclusively in the first dielectric layer and/or the patch area. It is only decisive that the recesses are configured in such a way that a part of the upper or lower side of the patch area is uncovered or a part of the patch area is removed.

Figure 7:
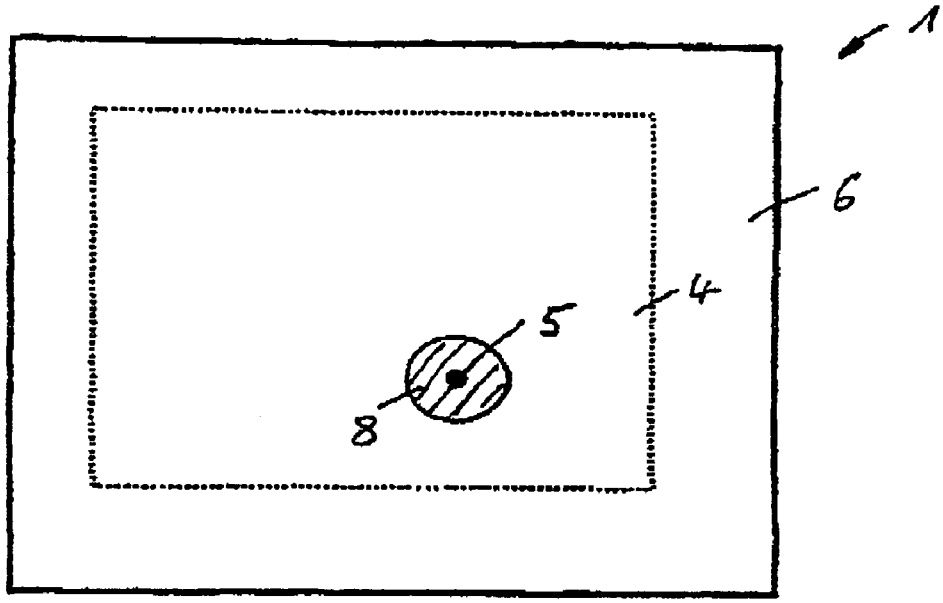
FIG. 7 shows a plan view of a further embodiment of the antenna according to the invention with a circular recess in the interior of the antenna.

FIG. 7 shows a further variant of the patch antenna according to the invention in plan view, the recess 8 being arranged in the inner region of the cross-section of the patch area 4 and extending through the second dielectric layer 6 to the upper side of the patch area 4. The region of the patch area uncovered by the recess is again shown hatched. The recess was selected in this case in such a way that, in plan view, it rests over the feed line 5. Owing to this position, the radiation characteristic of the patch antenna is particularly effectively changed.

In the production of patch antennas from FIGS. 5 to 7, care is to be taken that a patch antenna is firstly manufactured, which has continuous first and second dielectric substrate layers and a continuous patch area. Only at the end of the production process are corresponding recesses then provided in the dielectric substrates or in the patch area. The recesses are preferably provided successively and in intermediate steps a check is always made as to how the radiation characteristic has changed. This process is ended as soon as the desired radiation characteristic has been reached. For example, a recess 8 is initially only provided in such a way that only the patch area is uncovered. If the radiation properties of the patch antenna are not adequately changed thereby, further material can be removed from the patch area itself, optionally a whole part region can be cut out of the patch area and the recess can continue into the first dielectric substrate layer.

Figure 8:
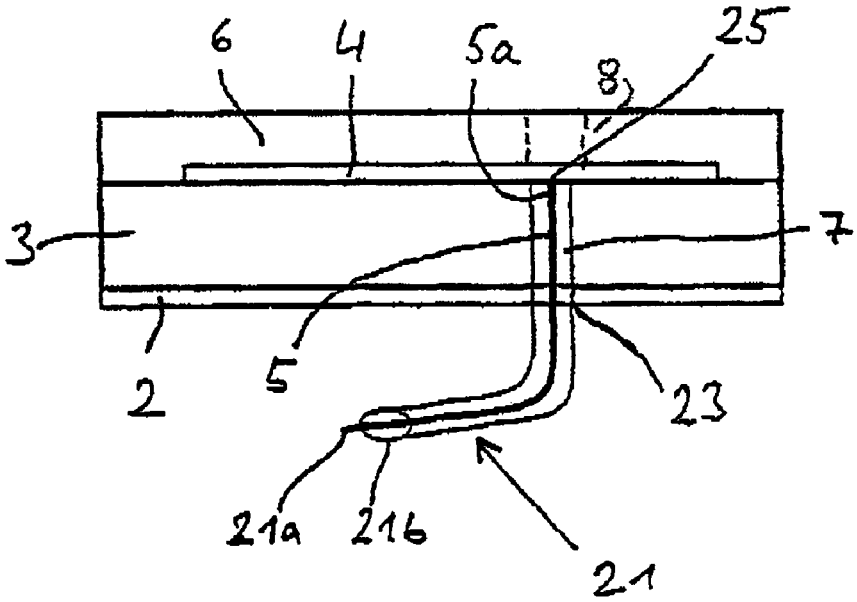
FIG. 8 shows a cross-sectional view corresponding to FIG. 2 with elucidation of the connection of a coaxial line.

FIG. 8 shows a corresponding view with respect to FIG. 2. In FIG. 8, an additional coaxial connection line 21 is also drawn in, specifically with an internal conductor 21*a* and an external conductor 21*b*. The electrically conductive outer conductor 21*b* is generally guided at least up to the lower ground plane 2 and electrically-galvanitically contacted there at a point 23 (around the outer periphery of the external conductor) by the ground plane 2.

The internal conductor 21*a* may in this case project over the end of the external conductor 21*b* and therefore lead beyond the ground plane 2. In this case, the internal conductor 21*a* can be connected at its upper end 5*a* at a point 25 to the patch area 4 in an electric-galvanitic manner (generally soldered on here also). Therefore, the internal conductor 21*a* passes into the so-called feed line 5 according to FIG. 1 to 7.

However, the feed line 5 may also extend from the upper patch area 4 through the channel-shaped opening 7 extending through the substrate layer 3 and be electrically connected at the lower end, for example to the internal conductor 21*a* of the coaxial line 21.

A coaxial connection may also be rigidly provided, for example, primarily at the level of the lower ground plane 2, the external conductor of which coaxial connection is connected to the ground plane 2, and its internal conductor to the feed line 5. Thus a corresponding coaxial cable 21 can be connected to this coaxial connection, for which purpose the coaxial cable 21 is then preferably also equipped at its end with a coaxial connector, in order to be connected therewith to the coaxial cable connection provided at the antenna.

The invention claimed is:

1. A planar patch antenna for connection to an electrically conductive feed line, said antenna having a plurality of areas and layers arranged one above the other along an axial axis, said patch antenna comprising:

an electrically conductive ground plane;

a first dielectric substrate layer, which is arranged on the ground plane, said first dielectric substrate layer having a first relative permittivity;

at least one electrically conductive effective area which is arranged on the first dielectric substrate layer and is electrically connected to an end of the electrically conductive feed line;

at least one second dielectric substrate layer arranged on the effective area and having a second relative permittivity, wherein the uppermost layer of the antenna does not consist of the electrically conductive effective area and/or the uppermost layer of the antenna comprises the at least one second dielectric substrate layer;

the second relative permittivity being larger than or equal to the first relative permittivity, at least one recess provided in the at least one second dielectric substrate layer, said at least one recess extending in the at least one second dielectric substrate layer in an axial direction up to the at least one effective area, the at least one recess being located over the end of the electric feed line.

2. The antenna as claimed in claim 1, wherein the first relative permittivity is between 1 and 8.

3. The antenna as claimed in claim 1, wherein the second relative permittivity is between 4 and 20.

4. The antenna as claimed in claim 1, wherein the thickness of the first dielectric substrate layer is larger than or equal to the thickness of the second dielectric substrate layer.

5. The antenna as claimed in claim 1, wherein the thickness of the at least one second dielectric substrate layer is larger than 10% of the thickness of the first dielectric substrate layer.

6. The antenna as claimed in claim 1, wherein the first and/or at least one second dielectric substrate layer and/or the effective area and/or the ground plane, in plan view in the axial direction, are circular or polygonal in design.

7. The antenna as claimed in claim 1, wherein the first and at least one second dielectric substrate layer, in plan view in the axial direction, have different sizes.

8. The antenna as claimed in claim 1, wherein the edge of the first dielectric substrate layer extends in axial section obliquely to the axial axis.

9. The antenna as claimed in claim 1, wherein the feed line is arranged in an opening extending through the ground plane and the first dielectric substrate layer and is connected at an end of the opening to the effective area.

10. The antenna as claimed in claim 1, wherein the recess is arranged inside a patch area.

11. The antenna as claimed in claim 1, wherein the first and/or at least one second dielectric substrate layer and/or the effective area have one or more recesses, which, in plan view in the axial direction, expose a partial region of the effective area or extend at least partially through the effective area.

12. The antenna as claimed in claim 11, wherein at least one of said recesses has an open side, which, in plan view in the axial direction, rests on an edge of the antenna.

13. The antenna as claimed in claim 12, wherein the length of the open side is at least 1/20 and at most half of the total length of the edge.

14. The antenna as claimed in claim 12, wherein the open side of the at least one recess of said recesses is arranged substantially in a central region of the edge of the antenna and the at least one recess of said recesses extends in plan view in the axial direction from the open side into the interior of the antenna.

15. The antenna as claimed in claim 11, wherein at least one recess in plan view in the axial direction, is arranged in a corner region of the antenna.

16. The antenna as claimed in claim 1, wherein the at least one recess comprising one or more recesses, in plan view in the axial direction, that have substantially the form of a polygon and/or are circular.

17. The antenna as claimed in claim 1, wherein the antenna has a plurality of first and second dielectric substrate layers located one above the other, comprising effective areas located in between.

18. The antenna as claimed in claim 1, wherein the upper side of the effective area is covered by at least one second dielectric substrate layer and specifically in such a way that the substrate layer projects over the effective area.

* * * * *